US009858882B2

(12) United States Patent
Tomiyoshi et al.

(10) Patent No.: US 9,858,882 B2
(45) Date of Patent: Jan. 2, 2018

(54) DISPLAY APPARATUS WITH WAVEFORM ADJUSTER GENERATING SWITCH CONTROL SIGNAL BY SWITCHING BETWEEN GROUNDED STATE AND UNGROUNDED STATE

(71) Applicant: Sharp Kabushiki Kaisha, Osaka-shi, Osaka (JP)

(72) Inventors: Akira Tomiyoshi, Osaka (JP); Naoto Inoue, Osaka (JP); Aya Nakatani, Osaka (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 55 days.

(21) Appl. No.: 14/915,924

(22) PCT Filed: Oct. 16, 2014

(86) PCT No.: PCT/JP2014/077590
§ 371 (c)(1),
(2) Date: Mar. 2, 2016

(87) PCT Pub. No.: WO2015/060198
PCT Pub. Date: Apr. 30, 2015

(65) Prior Publication Data

US 2016/0196792 A1 Jul. 7, 2016

(30) Foreign Application Priority Data

Oct. 16, 2014 (JP) ..... 2013-218679

(51) Int. Cl.
*G09G 5/00* (2006.01)
*G09G 3/36* (2006.01)

(52) U.S. Cl.
CPC ..... *G09G 3/3677* (2013.01); *G09G 3/3696* (2013.01); *G09G 3/3648* (2013.01);
(Continued)

(58) Field of Classification Search
CPC .. G09G 3/3648; G09G 3/3677; G09G 3/3696; G09G 2310/0245; G09G 2310/06;
(Continued)

(56) References Cited

U.S. PATENT DOCUMENTS 7,027,017 B2 * 4/2006 Yer ..... G09G 3/3696 345/204
7,109,965 B1 * 9/2006 Lee ..... G09G 3/3648 345/92
(Continued)

FOREIGN PATENT DOCUMENTS

JP 2655328 B2 9/1997
JP 3406508 B2 5/2003
(Continued)

OTHER PUBLICATIONS

JP 2008-145677 (A) English Translation.*
Official Communication issued in International Patent Application No. PCT/JP2014/077590, dated Jan. 20, 2015.

*Primary Examiner* — Vijay Shankar
(74) *Attorney, Agent, or Firm* — ScienBiziP, P.C.

(57) ABSTRACT

By a simple circuit configuration, luminance unevenness is suppressed, and charge remaining after a power source supply is interrupted is suppressed. A slope control unit (52) generates a switch control signal (Von) having a waveform with a falling slope, by switching between a grounded state of being connected to a ground and an ungrounded state, and modulating the waveform of a high voltage (VGH), and in a case where a power supply from the outside is interrupted, the slope control unit (52) is in the ungrounded state.

6 Claims, 6 Drawing Sheets

(52) U.S. Cl.
CPC . *G09G 2310/0245* (2013.01); *G09G 2310/06* (2013.01); *G09G 2320/0233* (2013.01); *G09G 2320/0257* (2013.01); *G09G 2330/027* (2013.01); *G09G 2330/12* (2013.01)

(58) Field of Classification Search
CPC ... G09G 2320/0233; G09G 2320/0257; G09G 2330/027; G09G 2330/12
See application file for complete search history.

(56) References Cited

U.S. PATENT DOCUMENTS

| | | | | |
|---|---|---|---|---|
| 7,408,541 | B2 * | 8/2008 | Fukutoku ..... | G06F 1/3203 345/211 |
| 2002/0057245 | A1 | 5/2002 | Yanagi et al. | |
| 2004/0189629 | A1 | 9/2004 | Fukutoku | |

FOREIGN PATENT DOCUMENTS

| | | | |
|---|---|---|---|
| JP | 2008-145677 | A | 6/2008 |
| JP | 4180743 | B2 | 11/2008 |
| JP | 4544827 | B2 | 9/2010 |

* cited by examiner

DISPLAY APPARATUS WITH WAVEFORM ADJUSTER GENERATING SWITCH CONTROL SIGNAL BY SWITCHING BETWEEN GROUNDED STATE AND UNGROUNDED STATE

TECHNICAL FIELD

The present invention relates to a display apparatus.

BACKGROUND ART

In a liquid crystal display apparatus of an active matrix drive system, a technology for causing outputs of all gate drivers to have a high voltage (VGH) at the time of turning off a power source and for removing a charge written in a pixel electrode is used so that an image does not remain on a display surface after the power source is turned off.

However, there is a case where a liquid crystal panel that is mounted on a tablet is driven by power supplied from a battery, and a sudden power source OFF state (hereinafter referred to as panic-off) is caused by removing the battery or the like. In this manner, in a case where the supply of the power is interrupted by the panic-off, since a normal display OFF sequence is not performed, a phenomenon (common name: charge remaining) in which an image remains on a display surface occurs.

In PTL 1 and PTL 2, technologies that solve such problems are disclosed.

PTL 1 discloses a method for supplying an operation power source voltage to a gate bus drive circuit through a power source retaining circuit which is capable of retaining the power for a predetermined period of time, for detecting turning off in the case where the power source is turned off, and for simultaneously turning on all transistors connected to the gate bus for a fixed period of time immediately after the power source is turned off.

PTL 2 discloses a liquid crystal display apparatus that includes two diodes which are connected in series in one direction between a drive power source for a source driver and a ground potential, and in which a source line is connected to a connecting point of the diode. According to the liquid crystal display apparatus of PTL 2, in the case where the power source is turned off, it is possible to output a gate high signal to all gate lines, and it is possible to discharge the voltage which is accumulated in a liquid crystal layer through the diode by configuring the drive power source for the source driver to the ground potential.

Moreover, in the liquid crystal display apparatus, there is a problem that in a delay of a gate signal that is transmitted by a gate line connected to a gate electrode of a TFT arranged in each pixel, the level shift of the potential of the pixel electrode due to parasitic capacitance becomes non-uniform depending on a position of the pixel, and as a result, luminance unevenness of a display image occurs.

In order to solve the problem, there is known a technology for controlling a waveform of the gate pulse so as to be a waveform having a falling slope. For example, a gate slope type liquid crystal display apparatus using such a technology is disclosed in PTL 3.

Furthermore, PTL 4 discloses a gate slope type liquid crystal display apparatus in which a countermeasure against the panic-off is carried out. FIG. 5 is a diagram illustrating a configuration example of a liquid crystal display apparatus of PTL 4. FIG. 6 is a diagram illustrating a waveform of a signal which is input to or is output from a gate drive circuit of the liquid crystal display apparatus of PTL 4.

As illustrated in FIG. 5, the liquid crystal display apparatus of PTL 4 includes a luminance slope circuit 201, a power retaining circuit 202, a power source switching circuit 203, and a gate drive circuit 204.

The luminance slope circuit 201 changes an input gate on-state voltage Von in synchronization with an output of the gate drive circuit 204 and outputs a gate on-state voltage for the gate drive circuit as illustrated in a power source Vgon of FIG. 6.

The power retaining circuit 202 retains the power supplied by the gate on-state voltage Von for a predetermined time and is configured by using a capacitor or the like having a sufficiently large capacitance.

The power source switching circuit 203 outputs an output voltage of the luminance slope circuit 201 to the gate drive circuit 204, in the case where a voltage value of an apparatus power source Vin from a power source apparatus which is not illustrated in the drawing is higher than a predetermined voltage value, and outputs an output voltage of the power retaining circuit 202 to the gate drive circuit 204 in the case where the voltage value of the apparatus power source Vin is equal to or lower than the predetermined voltage value.

The output voltage of the power source switching circuit 203, a gate off-state voltage Voff, and a logic voltage Vcc are supplied to the gate drive circuit 204.

At the time of normal driving in which the apparatus power source Vin is normally supplied to the liquid crystal display apparatus (in the case where the apparatus power source Vin is 3.3 V), the gate drive circuit 204 sequentially outputs a pulse signal (VOUT1 to VOUTn) which is generated by synthesizing the output of the luminance slope circuit 201 and the gate off-state voltage Voff per one gate line cycle. Since the output voltage of the luminance slope circuit 201 is changed in synchronization with a fall of a gate clock signal, an output VOUTi of the gate drive circuit 204 also becomes a drive waveform of which intentionally falls in a blunt manner. Accordingly, it is possible to suppress the luminance unevenness on the display surface.

On the other hand, at the time of turning off the power source in which the apparatus power source Vin supplied to the liquid crystal display apparatus is interrupted (at a time t1 in which the apparatus power source Vin becomes 0 V), the voltage which is retained in the power retaining circuit 202 at a time t2 after the power source is turned off is supplied to the gate drive circuit 204. Therefore, the gate drive circuit 204 is non-synchronized regardless of other input signals and outputs the output of the power retaining circuit 202 to all of the output terminals of the gate drive circuit 204 (VOUT1 to VOUTn).

Accordingly, all of the thin film transistors are in an ON state in a display unit 206, and the charge which remains in the liquid crystal is quickly released, and thereby, it is possible to erase the display, and it is possible to avoid an afterimage being visible at the time of turning off the power source.

CITATION LIST

Patent Literature

PTL 1: Japanese Patent No. 2655328 (registered May 30, 1997)

PTL 2: Japanese Patent No. 4180743 (registered Sep. 5, 2008)

PTL 3: Japanese Patent No. 3406508 (registered Mar. 7, 2003)

PTL 4: Japanese Patent No. 4544827 (registered Jul. 9, 2010)

SUMMARY OF INVENTION

Technical Problem

However, in the liquid crystal display apparatus of PTL 4, in order to carry out the countermeasure against the panic-off in the gate slope type liquid crystal display apparatus, there is a need for a circuit such as the power source switching circuit 203 or the power retaining circuit 202, and the circuit configuration becomes complex. As a result, the miniaturization and cost reduction of the liquid crystal display apparatus are inhibited.

The present invention is made in consideration of the above problems, and an object thereof is to provide a liquid crystal display apparatus that can suppress luminance unevenness on a display surface and suppress charge remaining after a power source supply is interrupted, by a simple circuit configuration.

Solution to Problem

In order to solve the above problems, according to one aspect of the present invention, there is provided a display apparatus including a plurality of pixels, and a signal generating unit that generates a switch control signal for controlling a switch element arranged in each pixel in which the signal generating unit includes a high voltage generating unit and a waveform adjusting unit, the high voltage generating unit supplies a high voltage for causing the switch element to be in an ON state to the waveform adjusting unit, the waveform adjusting unit generates the switch control signal having a waveform with a falling slope, by switching between a grounded state of being connected to a ground and an ungrounded state of not being connected to the ground and modulating the waveform of the high voltage, and in a case where a power supply from the outside is interrupted, the waveform adjusting unit is in the ungrounded state.

Advantageous Effects of Invention

According to one aspect of the present invention, it is possible to provide a liquid crystal display apparatus that can suppress luminance unevenness on a display surface and suppress the charge remaining after the power source supply is interrupted, by a simple circuit configuration.

DESCRIPTION OF EMBODIMENTS

[First Embodiment]

Hereinafter, embodiments of the present invention will be described in detail on the basis of FIG. 1 to FIG. 3. In the following description, a liquid crystal display apparatus will be described as an application example of the present invention, but the present invention may be applied to other display apparatuses, for example, an organic EL display apparatus.

Figure 1:
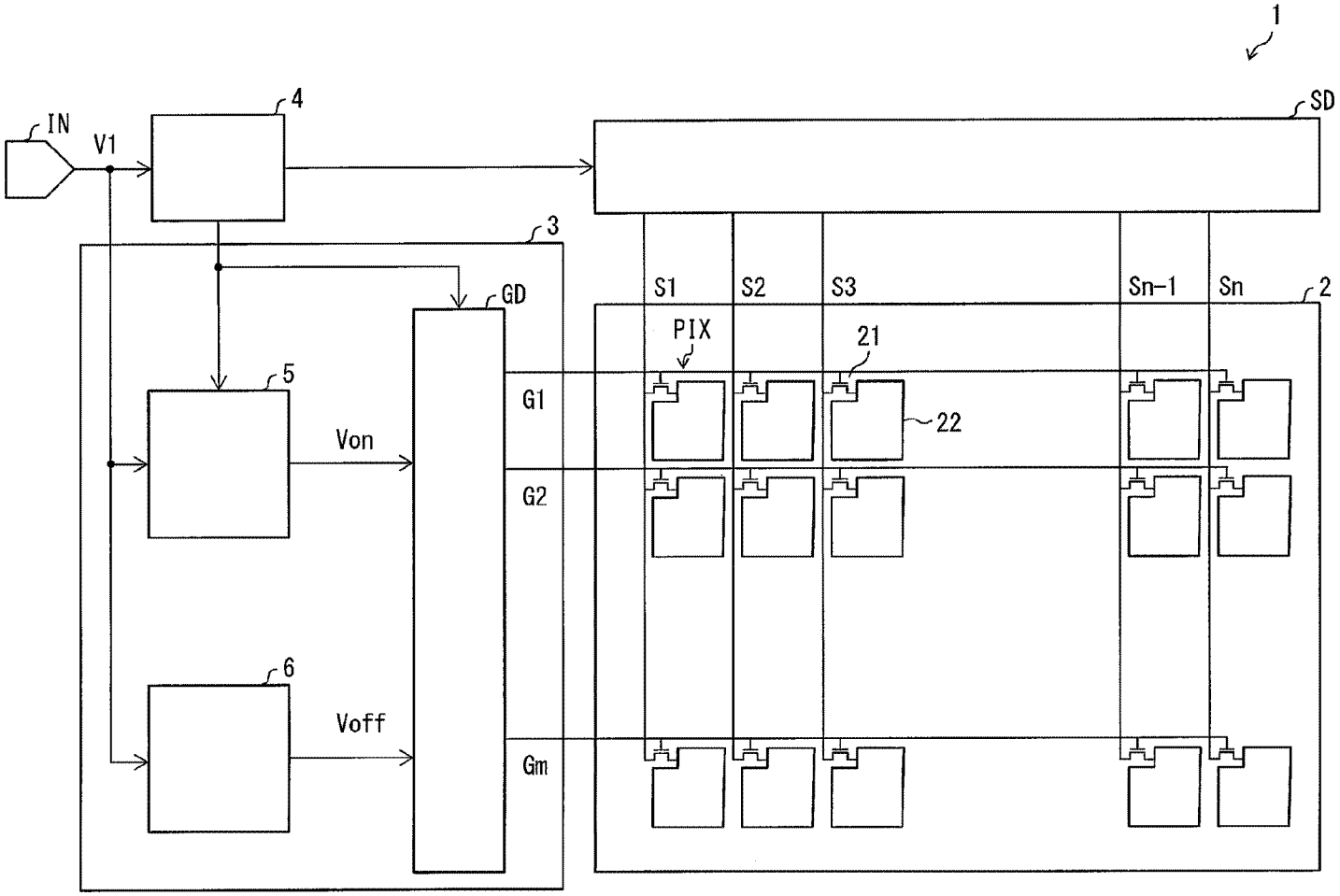
FIG. 1 is a block diagram of a liquid crystal display apparatus according to a first embodiment of the present invention.

FIG. 1 is a block diagram illustrating a configuration of a liquid crystal display apparatus according to a first embodiment.

As illustrated in FIG. 1, a liquid crystal display apparatus 1 includes a liquid crystal panel 2, a gate signal generating unit 3 (signal generating unit), a source driver SD, and a timing controller 4. Moreover, the liquid crystal display apparatus 1 includes an input terminal IN, and a power source voltage V1 for driving each circuit is supplied from the outside through the input terminal IN.

In the liquid crystal panel 2, m scanning signal lines G (G1, G2, . . . , Gm) extending in a horizontal direction in the drawing and n data signal lines S (S1, S2, . . . , Sn) extending in a vertical direction in the drawing are arranged.

Moreover, in the liquid crystal panel 2, a plurality of pixels PIX being areas which are surrounded by the scanning signal lines G and the data signal lines S, are formed. In the liquid crystal panel 2, in response to each pixel PIX, a TFT 21 (switch element) and a pixel electrode 22 are arranged.

A gate terminal of the TFT 21 is connected to the scanning signal line G, a source terminal is connected to the data signal line S, and a drain terminal is connected to the pixel electrode 22.

One end of the scanning signal line G is connected to a gate driver GD which will be described later, and one end of the data signal line S is connected to the source driver SD which will be described later.

The gate signal generating unit 3 includes the gate driver GD, an on-state voltage generating unit 5, and an off-state voltage generating unit 6.

The on-state voltage generating unit 5 generates a gate on-state voltage Von (switch control signal) being a voltage which is sufficient for causing an ON state by controlling the TFT 21, on the basis of the power source voltage V1, and supplies the voltage to the gate driver GD. The off-state voltage generating unit 6 generates a gate off-state voltage Voff being a voltage for causing the TFT 21 to be in an OFF state, on the basis of the power source voltage V1, and supplies the voltage to the gate driver GD.

The gate driver GD generates a gate signal for controlling the ON state and the OFF state of the TFT 21, on the basis of the gate on-state voltage Von and the gate off-state voltage Voff, and sequentially applies the signal to each scanning signal line G. For example, the gate on-state voltage Von may be set to 24 V, and the gate off-state voltage Voff may be set to −5 V.

As described above, the gate signal generating unit 3 generates the gate signal, and applies the gate signal to the scanning signal line G, and thereby, controls the ON state and the OFF state of the TFT 21.

The source driver SD supplies a data signal that is generated as a voltage which is applied to the pixel electrode 22 of each pixel PIX on the basis of a video signal to each data signal line S, in response to each data signal line S. Thereby, the data signal is written in the pixel electrode 22 through the TFT 21 in the ON state.

The timing controller 4 supplies a signal that becomes a standard for operating each of the circuits in synchronization with each other to each of the circuits, on the basis of a horizontal synchronization signal and a vertical synchronization signal that are input from a control unit which is not illustrated in the drawing. Specifically, a gate start pulse signal and a gate clock signal are supplied to the gate driver GD on the basis of the vertical synchronization signal. A source start pulse signal, a source latch strobe signal, a source clock signal, and the video signal depending on an input image are supplied to the source driver SD, on the basis of the horizontal synchronization signal.

The gate driver GD starts scanning of the liquid crystal panel 2 by using the gate start pulse signal which is received from the timing controller 4 as a trigger and continues to sequentially apply a selection voltage to each scanning signal line G in accordance with the gate clock signal being a signal which causes the scanning signal line G to be in a selection state. The source driver SD supplies an image data signal to each data signal line S of the liquid crystal panel 2 on the basis of the source start pulse signal which is received from the timing controller 4.

<On-state Voltage Generating Unit>

The detailed configuration of the on-state voltage generating unit of the embodiment will be described on the basis of FIG. 2.

Figure 2:
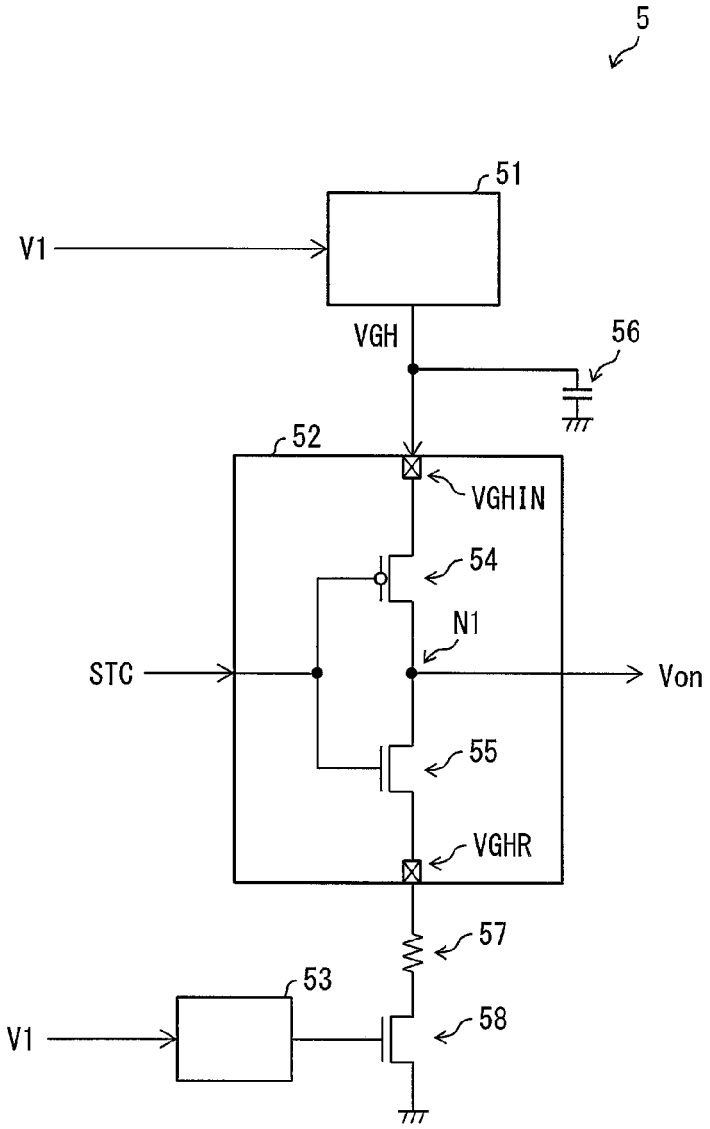
FIG. 2 is a block diagram illustrating a configuration of an on-state voltage generating unit.

FIG. 2 is a block diagram illustrating the configuration of the on-state voltage generating unit.

The on-state voltage generating unit 5 includes a VGH generating circuit 51 (high voltage generating unit), a slope control unit 52 (waveform adjusting unit), and a voltage drop detecting circuit 53 (stop detecting unit).

The VGH generating circuit 51 generates a high voltage VGH being a voltage which is sufficient for causing the TFT 21 to be in the ON state, on the basis of the power source voltage V1 which is supplied from the input terminal IN, and supplies the high voltage VGH to the slope control unit 52. The output of the VGH generating circuit 51 is connected to the ground through a capacitor 56.

The slope control unit 52 includes a P-type FET 54, an N-type FET 55, a high voltage input terminal VGHIN to which the high voltage VGH is input, and a GND connection terminal VGHR. The high voltage input terminal VGHIN and a node N1 are connected to each other through the P-type FET 54, and the GND connection terminal VGHR and the node N1 are connected to each other through the N-type FET 55.

A slope control signal STC which is output from the timing controller 4 is input to the gate terminal of the P-type FET 54 and the gate terminal of the N-type FET 55. The slope control signal STC is a clock signal and alternately switches between the ON state and the OFF state of the P-type FET 54 and the N-type FET 55.

The node N1 is connected to the gate driver GD, and the gate on-state voltage Von is output from the slope control unit 52 depending on the potential of the node N1.

The GND connection terminal VGHR is connected to the ground (GND) through a resistor 57 for the slope, as a pull-down resistor, and a FET 58 for an off-state countermeasure (switch element for the control). That is, a first terminal of the FET 58 for the off-state countermeasure is connected to the GND connection terminal VGHR through the resistor 57 for the slope, and a second terminal of the FET 58 for the off-state countermeasure is connected to the ground.

The voltage drop detecting circuit 53 outputs a high voltage sufficient for causing the FET 58 for the off-state countermeasure to be in the ON state, in the case where the power source voltage V1 is supplied from the input terminal IN, and the power source voltage V1 is higher than a predetermined threshold and outputs a low voltage (supply stop signal) sufficient for causing the FET 58 for the off-state countermeasure to be in the OFF state, in the case where the power source voltage V1 is lower than the predetermined threshold. The output of the voltage drop detecting circuit 53 is connected to the gate terminal (control terminal) that controls conduction of the first terminal and the second terminal of the FET 58 for the off-state countermeasure. As a voltage drop detecting circuit 53, it is possible to use a general reset IC.

<Operation>

At the time of the normal driving in which the power source voltage V1 is normally supplied, since the voltage drop detecting circuit 53 outputs the high voltage, the FET 58 for the off-state countermeasure maintains the ON state.

Therefore, in the slope control unit 52, in the case where the P-type FET 54 is in the ON state and the N-type FET 55 is in the OFF state, the node N1 is electrically connected to a high voltage input terminal VGHIN, and thereby, a high voltage supply state where the high voltage VGH is supplied from the VGH generating circuit 51 is caused, and the potential of the node N1 is pulled up to the potential of the high voltage VGH.

On the other hand, in the case where the P-type FET 54 is in the OFF state, and the N-type FET 55 is in the ON state, the node N1 is electrically connected to the GND connection terminal VGHR, and thereby, the potential of the node N1 is pulled down to the potential of the ground (the potential of the node N1 is discharged to the ground). At this time, a high voltage non-supply state where the high voltage VGH is not supplied from the VGH generating circuit 51 is caused.

By alternately switching between the ON states and the OFF states of the P-type FET 54 and the N-type FET 55, a grounded state where the node N1 is connected to the ground and an ungrounded state where the node N1 is not connected to the ground are alternately switched. As a result, the waveform of the high voltage VGH is modulated, and the waveform of the gate on-state voltage Von which is output from the slope control unit 52 has a falling slope. Thereby, it is possible to suppress the occurrence of luminance unevenness in accordance with the position of the pixel from the gate driver GD.

On the other hand, in the case where the power supply from the outside is interrupted by the panic-off or the like, and the power source voltage V1 is not supplied, since the voltage drop detecting circuit 53 outputs the low voltage, the FET 58 for the off-state countermeasure becomes in the OFF state (OPEN state), and the GND connection terminal VGHR is insulated from the ground. As a result, the potential of the node N1 is not pulled down to the potential of the ground through the resistor 57 for the slope.

Therefore, even in the case where the power source voltage V1 is not supplied by the panic-off or the like, since it is possible to supply the voltage which is necessary for causing the TFT 21 of the liquid crystal panel 2 to be in the ON state to the gate driver, it is possible to remove the charge from the pixel PIX, and it is possible to suppress the occurrence of the charge remaining.

Figure 3:
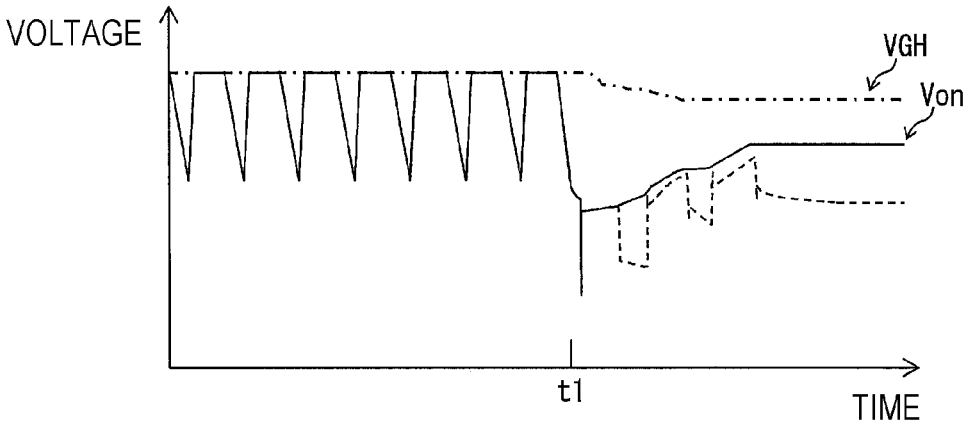
FIG. 3 is a diagram illustrating waveforms of a high voltage VGH which is output from a VGH generating circuit, and a gate on-state voltage Von which is output from a slope control unit.

FIG. 3 is a diagram illustrating the waveform of the high voltage VGH which is output from the VGH generating circuit and the gate on-state voltage Von which is output from the slope control unit 52. The horizontal axis indicates time, and the vertical axis indicates voltage. In the drawing, a one-dot chain line denotes the waveform of the high voltage which is output from the VGH generating circuit, and a solid line and a broken line denote the waveforms of the gate on-state voltage Von.

As illustrated in FIG. 3, the waveform of the gate on-state voltage Von before the time t1 has a rising voltage which is the high voltage VGH, and has the falling slope.

Moreover, in the liquid crystal display apparatus of the related art, in the case where the panic-off is caused in the state in which the node N1 is grounded to the ground, as illustrated by the broken line, the gate on-state voltage Von continues to decrease after the time t1.

On the contrary, according to the liquid crystal display apparatus of the embodiment, in the case where the panic-off is caused, since the ungrounded state where the node N1 is not connected to the ground is caused, as illustrated by the solid line, it is possible to suppress lowering of the gate on-state voltage Von after the time t1. Therefore, even in the case where the power source voltage V1 is not supplied by turning off the power source, thereafter, it is possible to supply the voltage which is necessary for causing the TFT 21 of the liquid crystal panel 2 to be in the ON state to the gate driver, it is possible to remove the charge from the pixel PIX, and it is possible to suppress the occurrence of the charge remaining.

[Second Embodiment]

If another embodiment of the present invention will be described on the basis of FIG. 4, the description will be as follows. For convenience of the description, the same reference signs are appended to members having the same functions as the members which are described in the above embodiment, and the description thereof will be omitted.

Figure 4:
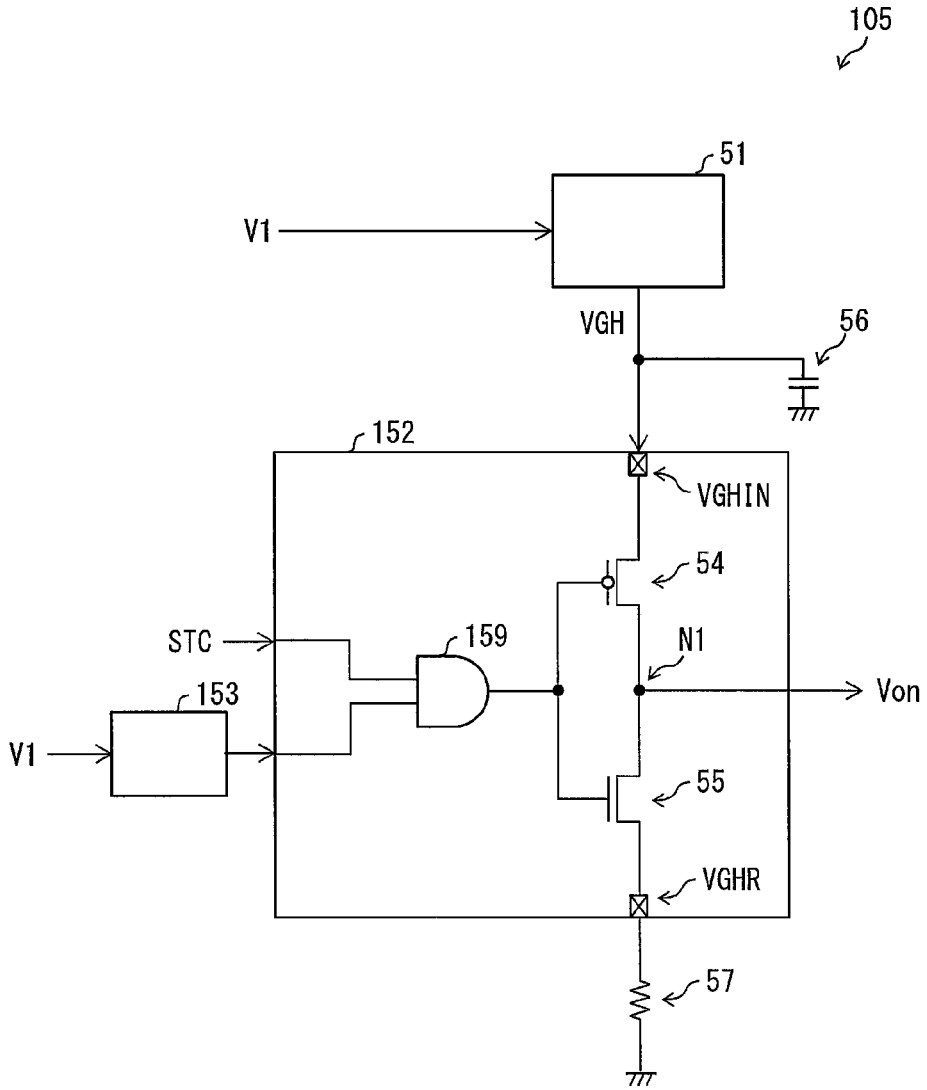
FIG. 4 is a block diagram illustrating a configuration of an on-state voltage generating unit of a liquid crystal display apparatus according to a second embodiment of the present invention.
Figure 5:
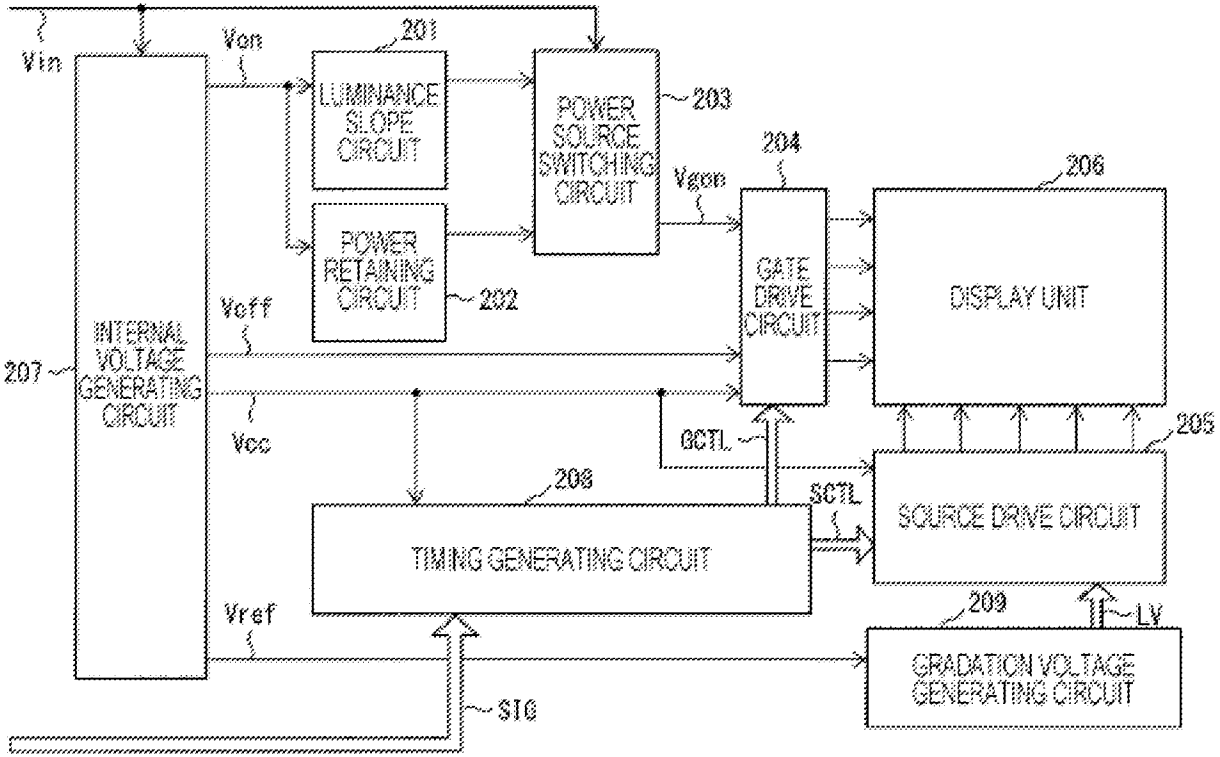
PRIOR ART FIG. 5
FIG. 5 is a configuration diagram illustrating feature components of a liquid crystal display apparatus of PTL 4 as the related art.
Figure 6:
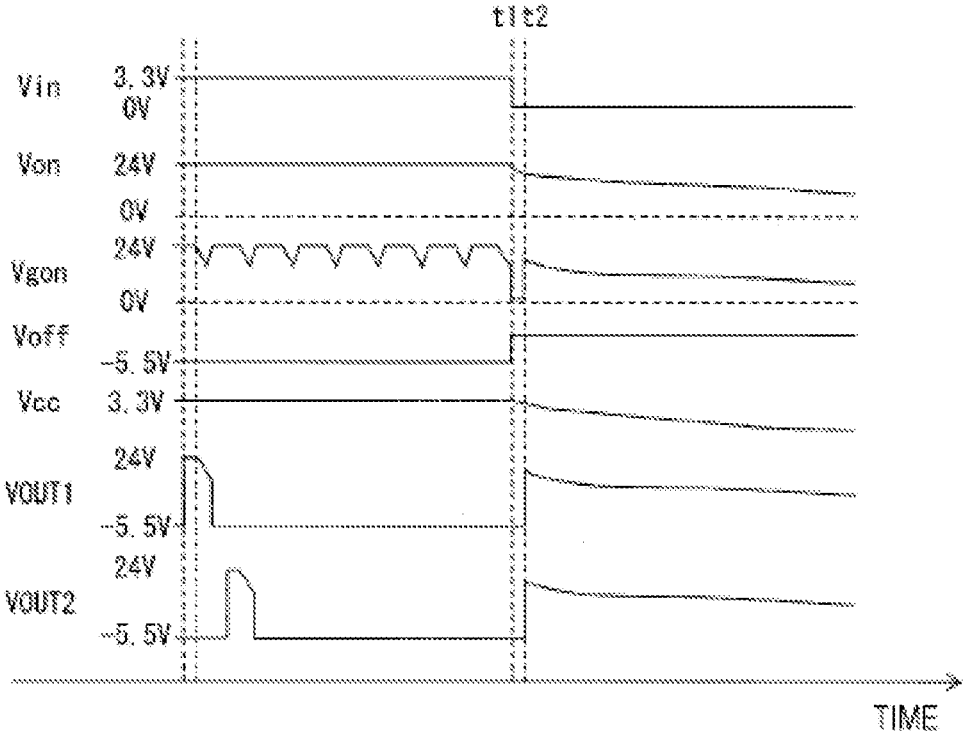
FIG. 6 PRIOR ART
FIG. 6 is a diagram illustrating a waveform of a signal which is input to or is output from a gate drive circuit of the liquid crystal display apparatus of PTL 4.

FIG. 4 is a block diagram illustrating a configuration of an on-state voltage generating unit of a second embodiment.

As illustrated in FIG. 4, a slope control unit 152 of the embodiment includes an AND circuit 159. The slope control signal STC which is supplied from the timing controller 4, and an output signal of the voltage drop detecting circuit 153 are input to the input terminal of the AND circuit 159. Moreover, the output terminal of the AND circuit 159 is connected to the gate terminal of the P-type FET 54 and the gate terminal of the N-type FET 55.

At the time of the normal driving in which the power source voltage V1 is normally supplied, since the voltage drop detecting circuit 153 outputs the high voltage, and the signal depending on the slope control signal STC is output from the output terminal of the AND circuit 159, the ON states and the OFF states of the P-type FET 54 and the N-type FET 55 are alternately switched. As a result, the waveform of the gate on-state voltage Von which is output from the slope control unit 152, has the falling slope. Thereby, it is possible to suppress the occurrence of the luminance unevenness depending on the position of the pixel from the gate driver GD.

On the other hand, by the panic-off or the like, in the case where the power source voltage V1 is not supplied, since the voltage drop detecting circuit 153 outputs the low voltage, and the signal of the low voltage is output from the output terminal of the AND circuit 159, the P-type FET 54 becomes in the ON state, and the N-type FET 55 becomes in the OFF state. Thereby, even in the case where the power source voltage V1 is not supplied, the potential of the node N1 is not pulled down to the potential of the ground. Furthermore, the electrical connection of the node N1 to the high voltage input terminal VGHIN is fixed, and thereby, the potential of the node N1 is pulled up to the potential of the high voltage VGH.

Therefore, even in the case where the power source voltage V1 is not supplied by turning off the power source, since it is possible to supply the voltage which is necessary for causing the TFT 21 of the liquid crystal panel 2 to be in the ON state to the gate driver, it is possible to remove the charge from the pixel PIX, and it is possible to suppress the occurrence of the charge remaining.

[Third Embodiment]

If another embodiment of the present invention will be described, the description will be as follows. Furthermore, for convenience of the description, the same reference signs are appended to members having the same functions as the members which are described in the above embodiment, and the description thereof will be omitted.

In the liquid crystal display apparatus of a third embodiment, as a TFT 21, a TFT using a so-called oxide semiconductor in a semiconductor layer thereof is adopted. In the oxide semiconductor, for example, an IGZO (InGaZnOx: registered trademark) being an InGaZnO-based oxide semiconductor is included.

The TFT using the oxide semiconductor has electron mobility at the time of the ON state which is higher as approximately 20 times to 50 times, in comparison with a TFT using a-Si, and has on-state performances which are very excellent.

In the liquid crystal display apparatus of the embodiment, by adopting the TFT using the oxide semiconductor in each element, the on-state performances of the TFT of each pixel become very excellent. Therefore, it is possible to increase an electron transfer amount at the time of writing the pixel data with respect to each pixel, and it is possible to make the time which is taken for the writing shorter.

On the other hand, in the case where the TFT 21 using the InGaZnO-based oxide semiconductor is adopted, the on-state performances are excellent, and thus, the charge of the pixel is unlikely to be removed in the case where the panic-off is made in the liquid crystal display apparatus.

However, as the first embodiment or the second embodiment, in the case where the supply of the power source voltage V1 is interrupted, by breaking the connection of the node N1 to the ground, it is possible to suppress the lowering of the potential of the node N1, and since it is possible to supply the voltage which is necessary for causing the TFT 21 of the liquid crystal panel 2 to be in the ON state to the gate driver, it is possible to remove the charge from the pixel PIX, and it is possible to suppress the occurrence of the charge remaining.

A display apparatus (liquid crystal display apparatus 1) according to a first aspect of the present invention, includes a plurality of pixels (PIX), and a signal generating unit (gate signal generating unit 3) that generates a switch control signal (gate on-state signal Von) for controlling a switch element (TFT 21) which is arranged in each pixel, in which the signal generating unit includes a high voltage generating unit (VGH generating circuit 51) and a waveform adjusting unit (slope control units 52 and 152), the high voltage generating unit supplies a high voltage for causing the switch element to be in an ON state to the waveform adjusting unit, the waveform adjusting unit generates the switch control signal having a waveform with a falling slope, by switching between a grounded state of being connected to a ground and an ungrounded state of not being connected to the ground, and modulating the waveform of the high voltage, and in a case where a power supply from the outside is interrupted, the waveform adjusting unit is in the ungrounded state.

According to the above configuration, it is possible to control the ON state and the OFF state of the switch element by the switch control signal having the falling slope. Thereby, since the level shift of the potential of the pixel electrode due to parasitic capacitance becomes nonuniform depending on the position of the pixel, it is possible to suppress luminance unevenness of a display image.

Furthermore, the waveform adjusting unit switches between the grounded state and the ungrounded state, but since the waveform adjusting unit becomes in the ungrounded state in the case where the power supply from the outside is interrupted, it does not continue to release the high voltage to the ground. Therefore, in the case where the power supply is interrupted, it is possible to supply the switch control signal that has the sufficient voltage for causing all of the switch elements which are arranged in each of the pixels to be in the ON state, and it is possible to suppress charge remaining on a display surface. That is, it is possible to make the countermeasure against the panic-off.

As described above, by a simple circuit configuration, it is possible to suppress the luminance unevenness on the display surface, and it is possible to suppress the charge remaining after a power source supply is interrupted.

In the first aspect, a display apparatus according to a second aspect of the present invention may be configured to include a stop detecting unit (voltage drop detecting circuits 53 and 153) that outputs a supply stop signal in the case where the power supply from the outside is interrupted, and a switch element for control (FET 58) that includes a first terminal which is connected to the waveform adjusting unit, a second terminal which is connected to the ground, and a control terminal which controls conduction of the first terminal and the second terminal, in which by inputting the supply stop signal to the control terminal, the first terminal is insulated from the second terminal, and the waveform adjusting unit is in the ungrounded state.

According to the above configuration, in the case where the power supply from the outside is interrupted, it is possible to cause the waveform adjusting unit to be in the ungrounded state by using the switch element for the control. Therefore, it is possible to suppress the charge remaining after the power source supply is interrupted by the simple circuit configuration.

In the first aspect, a display apparatus according to a third aspect of the present invention may be configured to include a stop detecting unit that outputs a supply stop signal in the case where the power supply from the outside is interrupted, in which on the basis of the supply stop signal, the waveform adjusting unit is in the ungrounded state.

In the third aspect, a display apparatus according to a fourth aspect of the present invention may be configured in which the waveform adjusting unit switches between a high voltage supply state where the high voltage is supplied from the high voltage generating unit and a high voltage non-supply state where the high voltage is not supplied, and on the basis of the supply stop signal, the waveform adjusting unit is in the high voltage supply state.

According to the above configuration, in the case where the power supply is interrupted, it is possible to make the output of the waveform adjusting unit be equal to the above high voltage. Therefore, in the case where the power supply is interrupted, it is possible to more reliably supply the voltage for causing all of the switch elements which are arranged in each of the pixels to be in the ON state.

In any one of the first aspect to the fourth aspect, a display apparatus according to a fifth aspect of the present invention may be configured in which the switch element is a TFT, and in a semiconductor layer of the TFT, an InGaZnO-based oxide semiconductor is used.

According to the above configuration, the on-state performances of the switch element become very excellent. Therefore, it is possible to increase the electron transfer amount at the time of writing the pixel data with respect to each pixel, and it is possible to make the time which is taken for the writing shorter.

The present invention is not limited to the respective embodiments described above, and may be variously modified within the scope which is illustrated the claims, and embodiments that are obtained by suitably combining technical means which are respectively disclosed in different embodiments are also included in the technical scope of the present invention. Furthermore, by combining the technical means which are respectively disclosed in the respective embodiments, it is possible to form a new technical feature.

INDUSTRIAL APPLICABILITY

The present invention may be suitably used in a display apparatus of an active matrix drive system.

REFERENCE SIGNS LIST

1 LIQUID CRYSTAL DISPLAY APPARATUS (DISPLAY APPARATUS)
3 GATE SIGNAL GENERATING UNIT (SIGNAL GENERATING UNIT)
21 TFT (SWITCH ELEMENT)
51 VGH GENERATING CIRCUIT (HIGH VOLTAGE GENERATING UNIT)
52, 152 SLOPE CONTROL UNIT (WAVEFORM ADJUSTING UNIT)
53, 153 VOLTAGE DROP DETECTING CIRCUIT (STOP DETECTING UNIT)
58 FET (SWITCH ELEMENT FOR CONTROL)
PIX PIXEL
VGH HIGH VOLTAGE
Von GATE ON-STATE VOLTAGE (SWITCH CONTROL SIGNAL)

The invention claimed is:

1. A display apparatus comprising:
a plurality of pixels;
a signal generator that generates a switch control signal for controlling a switch element arranged in each pixel,
a stop detector that outputs a supply stop signal in a case where a power supply from outside is interrupted;
a switch element for control that includes a first terminal, a second terminal, and a control terminal;
wherein the signal generator includes a high voltage generator and a waveform adjuster,
the high voltage generator supplies a high voltage for causing the switch element to be in an ON state to the waveform adjuster,
the waveform adjuster generates the switch control signal having a waveform with a falling slope by switching between a grounded state of being connected to a ground and an ungrounded state of not being connected to the ground, and modulating the waveform of the high voltage, and
in a case where the power supply from the outside is interrupted, the waveform adjuster is in the ungrounded state
wherein the first terminal is connected to the waveform adjuster, the second terminal is connected to the ground, and the control terminal controls conduction of the first terminal and the second terminal; and wherein by inputting the supply stop signal to the control terminal, the first terminal is insulated from the second terminal and the waveform adjuster is in the ungrounded state.

2. The display apparatus according to claim 1, further comprising:

a stop detector that outputs a supply stop signal in the case where the power supply from the outside is interrupted, wherein on the basis of the supply stop signal, the waveform adjuster is in the ungrounded state.

3. The display apparatus according to claim 2, wherein the waveform adjuster switches between a high voltage supply state where the high voltage is supplied from the high voltage generator and a high voltage non-supply state where the high voltage is not supplied, and on the basis of the supply stop signal, the waveform adjuster is in the high voltage supply state.

4. The display apparatus according to claim 1, wherein the switch element is a TFT, and in a semiconductor layer of the TFT, an InGaZnO-based oxide semiconductor is used.

5. A display apparatus comprising:

a plurality of pixels;

a signal generator that generates a switch control signal for controlling a switch element arranged in each pixel; and a stop detector;

wherein the signal generator includes a high voltage generator and a waveform adjuster, the high voltage generator supplies a high voltage for causing the switch element to be in an ON state to the waveform adjuster, the waveform adjuster generates the switch control signal having a waveform with a falling slope by switching between a grounded state of being connected to a ground and an ungrounded state of not being connected to the ground, and modulating the waveform of the high voltage, and wherein in a case where power supply from the outside is interrupted, the waveform adjuster is in the ungrounded state and the stop detector outputs a supply stop signal;

wherein the waveform adjuster switches between a high voltage supply state where the high voltage is supplied from the high voltage generator and a high voltage non-supply state where the high voltage is not supplied, and on the basis of the supply stop signal, the waveform adjuster is in the high voltage supply state.

6. The display apparatus according to claim 5, wherein the switch element is a TFT, and in a semiconductor layer of the TFT, an InGaZnO-based oxide semiconductor is used.

* * * * *